US009963653B2

(12) United States Patent
Mathur et al.

(10) Patent No.: US 9,963,653 B2
(45) **Date of Patent: *May 8, 2018**

(54) PROCESS FOR PREPARING TIER 3 REFERENCE FUEL

(71) Applicant: Johann Haltermann Limited, Houston, TX (US)

(72) Inventors: Indresh Mathur, Sugar Land, TX (US); Mark Hendron Overaker, Kingwood, TX (US)

(73) Assignee: Johann Haltermann Limited, Houston, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/668,334

(22) Filed: Aug. 3, 2017

(65) Prior Publication Data

US 2017/0335211 A1 Nov. 23, 2017

Related U.S. Application Data

(63) Continuation of application No. 15/048,097, filed on Feb. 19, 2016, now Pat. No. 9,752,087.

(51) Int. Cl.

| | |
|---|---|
| ***C10L 1/00*** | (2006.01) |
| ***C10L 1/06*** | (2006.01) |
| ***C10L 10/02*** | (2006.01) |
| ***C10L 1/16*** | (2006.01) |
| ***C10L 1/182*** | (2006.01) |
| ***C10L 1/24*** | (2006.01) |

(52) U.S. Cl.

CPC ..... *C10L 1/06* (2013.01); *C10L 1/1608* (2013.01); *C10L 1/1824* (2013.01); *C10L 1/24* (2013.01); *C10L 10/02* (2013.01); *C10L 2270/023* (2013.01); *C10L 2290/24* (2013.01)

(58) Field of Classification Search

CPC ..... C10L 1/06; C10L 1/1608; C10L 1/1824; C10L 1/24; C10L 10/02; C10L 2270/023; C10L 2290/24

See application file for complete search history.

(56) References Cited

U.S. PATENT DOCUMENTS

2009/0277078 A1* 11/2009 Schweiger ..... C10L 1/023 44/449

2013/0139431 A1 6/2013 Russo et al.

FOREIGN PATENT DOCUMENTS

GB 586161 3/1947

OTHER PUBLICATIONS

ASTM International Designation: D3734-05 (Reapproved 2010), Standard Specification for High-Flash Aromatic Naphthas1, ASTM International, Aug. 22, 2016, 3 pages, West Conshohocken, PA.

ASTM International Designation: D5443-14, Standard Test Method for Paraffin, Naphthene, and Aromatic Hydrocarbon Type Analysis in Petroleum Distillates Through 200° C by Multi-Dimensional Gas Chromatography[1], ASTM International, Aug. 22, 2016, 11 pages, West Conshohocken, PA.

* cited by examiner

*Primary Examiner* — Cephia D Toomer

(74) *Attorney, Agent, or Firm* — Butzel Long; Gunther J. Evanina

(57) ABSTRACT

A process for preparing an E10 test fuel in accordance with 40 CFR 1065.710(*b*) includes steps of combining an aromatic pre-blend having an aromatic distribution in accordance with 40 CFR 1065.710(*b*), or a combination of aromatic blendstocks that if combined into a mixture would have an aromatic distribution in accordance with 40 CFR 1065.710(*b*), with at least one paraffinic refining blendstock, and optionally adding ethanol, butane, olefin-containing blendstocks, sulfur compounds or sulfur-containing blendstocks as needed to meet the requirements of 40 CFR 1065.710(*b*).

10 Claims, No Drawings

PROCESS FOR PREPARING TIER 3 REFERENCE FUEL

CROSS-REFERENCE TO RELATED APPLICATIONS

The following is a continuation application which claims the benefit of U.S. Patent Application No. 15/048,097, filed Feb. 19, 2016, which is hereby incorporated by reference in its entirety.

FIELD OF THE DISCLOSURE

This disclosure relates to reference fuels used as a standard for emissions testing of light and heavy duty vehicles, and more particularly to the preparation of Tier 3 reference fuels.

BACKGROUND OF THE DISCLOSURE

In an effort to further reduce motor vehicle emissions and improve air quality and public health, the United States Environmental Protection Agency has promulgated new rules that require lowering of sulfur content in gasoline beginning in 2017, and reduction of evaporative emissions from passenger cars, light-duty trucks, medium-duty passenger vehicles, and some heavy-duty vehicles (40 CFR parts 79, 80, 85 et al., titled "Control of Air Pollution from Motor Vehicles: Tier 3 Motor Vehicle Emission and Fuel Standards; Final Rule). Under the Tier 3 program, gasoline shall not contain more than 10 parts per million sulfur on an annual average basis by Jan. 1, 2017. This reduction is expected to reduce catalyst fouling and substantially improve the effectiveness of the vehicle emission control systems, leading to significant reductions in emissions of nitrogen oxides, volatile organic compounds, carbon monoxide, particulate matter, benzene, sulfur dioxide, 1,3-butadiene, formaldehyde, acetaldehyde, acrolein, and ethanol.

Under the Tier 3 standards, new specifications for the gasoline emissions test fuel used for testing highway vehicles have been adopted to better match the fuel that is currently being used. Specifically, in-use gasoline has changed considerably since the EPA last revised specifications for gasoline. Sulfur and benzene levels have been reduced, and gasoline containing 10 percent ethanol by volume has replaced non-oxygenated gasoline across the country. Section 1065.710(b) of Title 40 of the Code of Federal Regulations specifies test fuel properties for gasoline with ethanol (low-level blend only). The specification requires an Antiknock Index (R+M)/2 of 87.0-88.4, a sensitivity (R−M) of 7.5 (minimum), a Dry Vapor Pressure Equivalent (DVPE) in units of kPa of 60.0-63.4, 10% evaporation during distillation at 49-60° C., 50% evaporation during distillation at 88-99° C., 90% evaporation during distillation at 157-168° C., a final boiling point of I93-216° C., a post-distillation residue of 2.0 milliliters (maximum) of a 100 milliliter specimen (see ASTM D86), total aromatic hydrocarbons content of 21.0-25.0 volume present, C6 aromatics (benzene) content of 0.5-0.7 volume percent, C7 aromatics (toluene) content of 5.2-6.4 volume percent, C8 aromatics content of 5.2-6.4 volume percent, C9 aromatics content of 5.2-6.4 volume percent, C 10 plus aromatics content of 4.4-5.6 volume percent, a total olefins content of 4.0-10.0 mass percent, an ethanol content of 9.6-10.0 volume percent (blended) or 9.4-10.2 volume percent (confirmatory), a total content of oxygenates other than ethanol of 0.1 volume percent (maximum), a sulfur content of 8.0-11.0 mg/kg, a lead content of 0.0026 g/liter (maximum), a phosphorus content of 0.0013 g/liter (maximum), copper corrosion of No. 1 Maximum per ASTM D130, a solvent-washed gum content of 3.0 mg/100 milliliters (maximum), and an oxidation stability of 1000 minutes (minimum) per ASTM D525. The ethanol (blended) specification is based on the volume percent ethanol content as determined during blending by the fuel supplier and as stated by the supplier at the time of fuel delivery (see 40 CFR 1065.710(b)(3)). The ethanol (confirmatory) specification refers to the volume percent ethanol content as determined analytically.

Section 1065.710 of Title 40 also specifies that the low-level ethanol-gasoline test fuel blend having nominally 10% ethanol (commonly called "E10 test fuel") must be prepared from typical refinery gasoline blending component, and "may not use pure compounds, except as follows: (i) you may use neat ethanol as a blendstock, (ii) you may adjust the test fuel's vapor pressure by adding butane, (iii) you may adjust the test fuel's benzene content by adding benzene, and (iv) you may adjust the test fuel's sulfur content by adding sulfur compounds that are representative of those found with in-use fuels."

It has been determined that it is extremely difficult to meet all of the antiknock, sensitivity, distillation, and compositional requirements of 40 USC § 1065.710(b) using typical refinery gasoline blending components in combination with neat ethanol, butane, benzene and representative sulfur compounds. Generally, substantial trial and error is required to achieve all specifications concurrently. Further, once an appropriate blend has been determined, it is only usable for a relatively short period of time, since typical refinery gasoline blending components are constantly changing due to factors such as the source of the crude oil and seasonal adjustments to refinery operating parameters. It is most difficult to formulate an E10 test fuel within the specification having the required ranges for the various aromatic species while also meeting the total aromatic content and fuel distillation profile. Typical refinery gasoline blending components (or blendstocks) having a high aromatic content include heavy straight run (HSR) naphtha (petroleum), Aromatic 100 (a composition generally comprising a minimum of 98.0 volume percent aromatics and having a flashpoint of about 100 degrees Fahrenheit), Aromatic 150 (a composition generally comprising a minimum of 98.0 volume percent aromatics and having a flashpoint of about 150 degrees Fahrenheit), and Aromatic 200 (a composition generally comprising a minimum of 98.0 volume percent aromatics and having a flashpoint of about 200 degrees Fahrenheit). A problem with these aromatic refinery streams is that the composition can vary widely from batch to batch. Specifically, the distribution of C7, C8, C9 and C10+ aromatics can vary considerably from batch to batch, making it very difficult to formulate a finished test fuel meeting the very tight specifications of 40 CFR 1065.710(b). It is particularly difficult to formulate an E10 test fuel in accordance with 40 CFR 1065.710(b) that complies with the various aromatic species ranges while also meeting the total aromatic content requirement and fuel distillation profile.

It is highly desirable to develop a process for preparing Eli) test fuels in accordance with 40 CFR 1065.710(b) without employing a trial and error process typically requiring several iterative failures before meeting all specifications.

SUMMARY OF THE DISCLOSURE

A process for preparing E10 test fuel in accordance with 40 CFR 1065.710(b) is described. The process includes steps of: (1) providing an aromatic pre-blend prepared by mixing an aromatic refinery blendstocks to obtain a mixture comprising aromatic compounds in proportions as specified in 40 CFR 1065.710(b); (2) combining the aromatic pre-blend with ethanol and at least one paraffinic refinery blendstock to obtain a composition complying with most of the compositional, fuel quality, and distillation profile requirements of 40 CFR 1065.710(b); and (3) optionally adding butane as needed to adjust vapor pressure in accordance with 40 CFR 1065.710(b), optionally adding sulfur containing blendstock(s) or sulfur compounds as needed to comply with 40 CFR 1065.710(b), and optionally adding olefin containing blendstock(s) as needed to comply with 40 CFR 1065.710(b).

Alternatively, a process for preparing E10 test fuel in accordance with 40 CFR 1065.710(b) may comprise mixing (blending) aromatic refinery blendstocks with at least one paraffinic refinery blendstock, wherein the aromatic refinery blendstocks are selected such that if blended together without the at least one paraffinic refinery blendstock the resulting aromatic refinery blendstock mixture would comprise aromatic compounds in proportions as specified in 40 CFR 1065.710(b). Such alternative process may further comprise optionally adding butane as needed to adjust vapor pressure in accordance with 40 CFR 1065.710(b), optionally adding sulfur-containing blendstocks or sulfur compounds as needed to comply with 40 CFR 1065.710(b), and optionally adding olefin-containing blendstock(s) as needed to comply with 40 CFR 1065.710(b).

Also described is an aromatic pre-blend useful for preparing an E10 test fuel in accordance with 40 CFR 1065.710 (b) by mixing it with a paraffinic refinery blendstock and optionally sulfur compound(s) and/or sulfur-containing blendstock(s), olefin-containing blendstock(s) and/or butane.

Other features and advantages of the present disclosure will become readily appreciated as the same becomes better understood after reading the following description.

DETAILED DESCRIPTION

It has been discovered that it is possible to substantially reduce, and typically eliminate, trial and error during preparation of E10 test fuel in accordance with 40 CFR 1065.710 (b) by first preparing an aromatic pre-blend having the required proportions of C6, C7, C8, C9 and C10+ aromatics, then combining the aromatic pre-blend with ethanol and a paraffinic refinery blendstock (refinery process stream) having a low aromatic content in proportions that are expected to provide the required ethanol and total aromatic content and distribution of 40 CFR 1065.710(b), and which is expected to provide the required distillation profile, anti-knock index, sensitivity, lead content, phosphorus content, copper corrosion characteristic, solvent-washed gum content, and oxidation stability. Thereafter, small amounts of butane can be added as needed to adjust the fuel vapor pressure, small amounts of sulfur-containing blendstock(s) representative of those found with in-use fuels can be added to raise the sulfur content to that required by 40 CFR 1065.710(b), and a small amount of olefin-containing blendstock(s) can be added to adjust the olefin content within the range required by 40 CFR 1065.710(b).

By properly adjusting the proportions of C6, C7, C8, C9 and C10+ aromatics in the pre-blend and combining the pre-blend with other blendstocks that do not have sufficiently high aromatic content to cause the C6-C10+ proportions in the combination to deviate substantially from that of the pre-blend, it is possible to meet all specification requirements without trial and error, or at least significantly reduce trial and error. In order to reduce or eliminate trial and error, it is desirable that the aromatic pre-blend is comprised of a very high proportion of aromatic compounds, such as at least 90 volume percent, at least 95 volume percent, or at least 98 volume percent. It is also desirable that the C6-C10+ proportions are as recited in 40 CFR 1065.710(b) (as published Apr. 28, 2014 at 79 FR 23809). Specifically, it is desirable that the C7: C6, C8:C6 and C9:C6 aromatic proportions are each in the range 5.2-6.4:0.5-0.7 (in units of volume), and that the C10+:C6 aromatic proportion is in the range 4.4-5.6:0.5-0.7 (in units of volume).

The paraffinic refinery blendstock (or blendstocks) should be selected such that when it is combined with ethanol and the aromatic pre-blend to provide a 10% ethanol gasoline (E10 test fuel), the resulting mixture has the distillation profile and other fuel characteristics specified in 40 CFR 1065.710(b). The paraffinic blendstock or combination of paraffinic blendstocks should have a low aromatics content such that the distribution of aromatics in the blendstock(s) does not cause the C6-C10+ proportions in the test fuel to vary significantly from the proportions in the pre-blend. It is recommended that the aromatic content of the refinery blendstock or combination of refinery blendstocks that are mixed with the aromatic pre-blend and the ethanol does not exceed 10 volume percent, 5 volume percent, or 2 volume percent. The ethanol can be pure, or substantially pure, e.g., at least 90 volume percent ethanol, at least 95 volume percent ethanol, or at least 96 volume percent ethanol.

Suitable aromatic refinery blendstocks that can be used for preparing the aromatic pre-blend include Aromatic-100, Aromatic-150, Aromatic-200, benzene, toluene, xylene (e.g., a mixture of o-, p- and m-xylene), 1,2,4-trimethyl benzene, 1,3,5-trimethyl benzene, diethylbenzene, and tetralin. Other blendstocks comprised primarily of aromatic species are also suitable and may be employed in the preparation of the aromatic pre-blend.

The C6-C10+ aromatic distributions and distillation profile for typical Aromatic-100 blendstocks is given in Table 1.

TABLE 1

| TEST | METHOD | UNITS | RESULTS SAMPLE A | RESULTS SAMPLE B |
|---|---|---|---|---|
| Distillation-IBP | ASTM D86 | ° F. | 316 | 325 |
| 5% | | ° F. | 321 | 326 |
| 10% | | ° F. | 322 | 326 |
| 20% | | ° F. | 324 | 326 |
| 30% | | ° F. | 326 | 327 |
| 40% | | ° F. | 327 | 327 |
| 50% | | ° F. | 328 | 327 |
| 60% | | ° F. | 329 | 328 |
| 70% | | ° F. | 332 | 328 |
| 80% | | ° F. | 336 | 329 |
| 90% | | ° F. | 339 | 330 |
| 95% | | ° F. | 340 | 333 |
| Distillation-EP | | ° F. | 351 | 345 |
| Recovery | | vol % | 98.3 | 98.5 |
| Residue | | vol % | 1.1 | 1.0 |
| Loss | | vol % | 0.7 | 0.5 |
| Gravity | ASTM D4052 | API | 30.5 | 30.5 |
| Density @ 60° F. | ASTM D4052 | $kg/m^3$ | 872.5 | 872.5 |
| Sulfur | ASTM D5453 | wt % | <1 | <1 |
| Aromatics. Total | ASTM D6733 | vol % | 98.3 | 99.0 |
| C8 Aromatics | ASTM D6733 | vol % | 5.5 | 0.2 |
| C9 Aromatics | ASTM D6733 | vol % | 76.6 | 92.1 |
| C10 Aromatics | ASTM D6733 | vol % | 15.5 | 5.9 |
| Peroxide Content | ASTM D3703 | ppm | <1 | <1 |

The compositional analysis of a typical Aromatic-150 blendstock is given in Table 2.

TABLE 2

| ASTM D-6733 | | | |
|---|---|---|---|
| Component Name | WT % | LV % | Mol % |
| n-Propylbenzene | 0.02 | 0.02 | 0.02 |
| 1-Methyl-3-ethylbenzene ( METOL) | 0.08 | 0.08 | 0.09 |
| 1-Methyl-4-ethylbenzene ( PETOL) | 0.05 | 0.05 | 0.06 |
| 1,3,5-Trimethylbenzene | 0.07 | 0.07 | 0.08 |
| 1-Methyl-2-ethylbenzene ( OETOL) | 0.07 | 0.07 | 0.08 |
| 1,2,4-Trimethylbenzene | 1.05 | 1.04 | 1.21 |
| Isobutylbenzene | 0.10 | 0.10 | 0.10 |
| sec-Butylbenzene | 0.12 | 0.12 | 0.12 |
| 1,2,3-Trimethylbenzene | 2.29 | 2.23 | 2.63 |
| 1-Methyl-3-isopropylbenzene | 0.30 | 0.30 | 0.31 |
| 1-Methyl-4-isopropylbenzene | 1.24 | 1.26 | 1.27 |
| 1-Methyl-2-isopropylbenzene | 1.72 | 1.71 | 1.77 |
| 1-Methyl-3-n-propylbenzene | 4.58 | 4.64 | 4.71 |
| 1-Methyl-4-n-propylbenzene | 4.64 | 4.71 | 4.77 |
| 1,3-Dimethyl-5-ethylbenzene | 5.28 | 5.30 | 5.43 |
| 1,2-Diethylbenzene | 0.45 | 0.45 | 0.46 |
| 1-Methyl-2-n-propylbenzene | 1.99 | 1.99 | 2.05 |
| 1,4-Dimethyl-2-ethylbenzene | 4.13 | 4.10 | 4.24 |
| 1,3-Dimethyl-4-ethylbenzene | 5.06 | 5.03 | 5.20 |
| 1,2-Dimethyl-4-ethylbenzene | 9.58 | 9.55 | 9.85 |
| 1,3-Dimethyl-2-ethylbenzene | 0.60 | 0.59 | 0.62 |
| 1,2-Dimethyl-3-Ethylbenzene | 2.67 | 2.61 | 2.74 |
| 1-ethyl-4-isopropylbenzene | 0.21 | 0.21 | 0.20 |
| 1,2,4,5-Tetramethylbenzene | 6.37 | 6.28 | 6.55 |
| 1,2,3,5-Tetramethylbenzene | 9.75 | 9.55 | 10.02 |
| 1,2,3,4-Tetramethylbenzene | 1.50 | 1.45 | 1.54 |
| Pentylbenzene | 7.12 | 7.23 | 6.63 |
| Naphthalene | 1.68 | 1.48 | 1.81 |
| C11 Aromatic | 25.45 | 25.63 | 23.68 |
| Pentamethylbenzene | 0.02 | 0.02 | 0.02 |
| 2-Methylnaphthalene | 0.02 | 0.02 | 0.02 |
| 1-Methylnaphthalene | 0.01 | 0.01 | 0.01 |
| Unidentified | 1.78 | 2.10 | 1.71 |
| | 100.00 | 100.00 | 100.00 |

| Summary by Group | | | |
|---|---|---|---|
| Totals | Group | % Wt | % Vol |
| | Paraffin | 0.00 | 0.00 |
| | Isoparaffin | 0.00 | 0.00 |
| | Olefin | 0.00 | 0.00 |
| | Naphthene | 0.00 | 0.00 |
| | Aromatic | 98.22 | 97.90 |
| | Oxygenates | 0.00 | 0.00 |
| | Unidentified | 1.78 | 2.10 |
| | | 100.00 | 100.00 |

| Summary by Carbon | | | |
|---|---|---|---|
| Totals | Group | % wt | % Vol |
| | C4 | 0.00 | 0.00 |
| | C5 | 0.00 | 0.00 |
| | C6 | 0.00 | 0.00 |
| | C7 | 0.00 | 0.00 |
| | C8 | 0.00 | 0.00 |
| | C9 | 3.63 | 3.56 |
| | C10 | 61.76 | 61.22 |
| | C11 | 32.83 | 33.12 |
| | C12 | 0.00 | 0.00 |

TABLE 2-continued

| ASTM D-6733 | | | |
|---|---|---|---|
| Composition by Carbon | | | |
| Group | C# | % wt | % Vol |
| Paraffin | C4 | 0.00 | 0.00 |
| | C5 | 0.00 | 0.00 |
| | C6 | 0.00 | 0.00 |
| | C7 | 0.00 | 0.00 |
| | C8 | 0.00 | 0.00 |
| | C9 | 0.00 | 0.00 |
| | C10 | 0.00 | 0.00 |
| | C11 | 0.00 | 0.00 |
| | C12 | 0.00 | 0.00 |
| isoparaffin | C4 | 0.00 | 0.00 |
| | C5 | 0.00 | 0.00 |
| | C6 | 0.00 | 0.00 |
| | C7 | 0.00 | 0.00 |
| | C8 | 0.00 | 0.00 |
| | C9 | 0.00 | 0.00 |
| | C10 | 0.00 | 0.00 |
| | C11 | 0.00 | 0.00 |
| | C12 | 0.00 | 0.00 |
| Olefin | C4 | 0.00 | 0.00 |
| | C5 | 0.00 | 0.00 |
| | C6 | 0.00 | 0.00 |
| | C7 | 0.00 | 0.00 |
| | C8 | 0.00 | 0.00 |
| | C9 | 0.00 | 0.00 |
| | C10 | 0.00 | 0.00 |
| | C11 | 0.00 | 0.00 |
| Naphthene | C4 | | |
| | C5 | 0.00 | 0.00 |
| | C6 | 0.00 | 0.00 |
| | C7 | 0.00 | 0.00 |
| | C8 | 0.00 | 0.00 |
| | C9 | 0.00 | 0.00 |
| | C10 | 0.00 | 0.00 |
| | C11 | 0.00 | 0.00 |
| Aromatic | C6 | 0.00 | 0.00 |
| | C7 | 0.00 | 0.00 |
| | C8 | 0.00 | 0.00 |
| | C9 | 3.63 | 3.56 |
| | C10 | 61.76 | 61.22 |
| | C11 | 32.83 | 33.12 |
| | C12 | 0.00 | 0.00 |

The compositional analysis of another typical Aromatic-150 blendstock is given in Table 3.

TABLE 3

| Total Aromatic 150 | | | |
|---|---|---|---|
| Sample ID | WT % | LV % | MOL % |
| Ortho-Xylene | 0.01 | 0.01 | 0.01 |
| n-Propylbenzene | 0.03 | 0.03 | 0.04 |
| 1-Methyl-3-ethylbenzene | 0.10 | 0.10 | 0.12 |
| 1-Methyl-4-ethylbenzene | 0.06 | 0.06 | 0.07 |
| 1,3,5-Trimethylbenzene | 0.11 | 0.11 | 0.13 |
| 1-Methyl-2-ethylbenzene | 0.14 | 0.14 | 0.16 |
| 1,2,4-Trimethylbenzene | 1.26 | 1.27 | 1.48 |
| Cis 1,3 diethylcyclohexane | 0.01 | 0.01 | 0.01 |
| Isobutylbenzene | 0.06 | 0.06 | 0.06 |
| sec-Butylbenzene | 0.07 | 0.07 | 0.07 |
| N-Decane | 0.03 | 0.04 | 0.03 |
| 1,2,3-Trimethylbenzene | 1.51 | 1.49 | 1.77 |
| 1-Methyl-3-isopropylbenzene | 0.15 | 0.15 | 0.16 |
| 1-Methyl-4-isopropylbenzene | 0.07 | 0.07 | 0.07 |
| Indan (2.3-Dihydroindene) | 0.53 | 0.48 | 0.63 |
| Sec-butylcyclohexane | 0.01 | 0.01 | 0.01 |
| 1-Methyl-2-isopropylbenzene | 0.03 | 0.03 | 0.03 |
| Butylcyclohexane | 0.64 | 0.70 | 0.64 |
| 1-Methyl-3-n-propylbenzene | 2.18 | 2.23 | 2.29 |
| 1-Methyl-4-n-propylbenzene | 0.76 | 0.78 | 0.80 |
| 1,4-Diethylbenzene | 1.71 | 1.74 | 1.80 |

TABLE 3-continued

| Total Aromatic 150 | | | |
|---|---|---|---|
| Sample ID | WT % | LV % | MOL % |
| 1,3-Dimethyl-5-ethylbenzene | 2.45 | 2.48 | 2.57 |
| 1,2-Diethylbenzene | 0.20 | 0.20 | 0.21 |
| 1-Methyl-2-n-propylbenzene | 1.69 | 1.70 | 1.78 |
| 5-Methyldecane | 0.03 | 0.04 | 0.03 |
| 2-Methyldecane | 0.04 | 0.05 | 0.04 |
| 1,4-Dimethyl-2-ethylbenzene | 3.09 | 3.09 | 3.25 |
| 1,3-Dimethyl-4-ethylbenzene | 0.52 | 0.52 | 0.55 |
| 3-Methyldecane | 0.02 | 0.02 | 0.02 |
| 1-Methylindan | 7.37 | 6.84 | 7.86 |
| 1,2-Dimethyl-4-ethylbenzene | 3.42 | 3.44 | 3.59 |
| 1,3-Dimethyl-2-ethylbenzene | 0.03 | 0.03 | 0.03 |
| 1,2-Dimethyl-3-Ethylbenzene | 2.66 | 2.62 | 2.79 |
| N-Undecane | 0.38 | 0.45 | 0.34 |
| 1,2,4,5-Tetramethylbenzene | 7.02 | 6.98 | 7.37 |
| 1,2,3,5-Tetramethylbenzene | 10.74 | 10.61 | 11.28 |
| 4-Methylindan | 3.33 | 3.09 | 3.55 |
| 5-Methylindan | 3.08 | 2.86 | 3.28 |
| 1,2,3,4-Tetramethylbenzene | 5.04 | 4.91 | 5.29 |
| Pentylbenzene | 1.79 | 1.83 | 1.70 |
| 1,1 Dimethylindan | 0.63 | 0.59 | 0.61 |
| 1,2 Dimethylindan | 2.51 | 2.34 | 2.42 |
| 1,6 Dimethylindan | 1.34 | 1.25 | 1.29 |
| C11 Aromatic | 18.98 | 19.30 | 18.05 |
| 1,3,5-triethylbenzene | 0.27 | 0.28 | 0.23 |
| 1,3 Dimethylindan | 0.77 | 0.72 | 0.74 |
| 5,6 Dimethylindan | 0.61 | 0.57 | 0.59 |
| 1,2,4-triethylbenzene | 0.42 | 0.42 | 0.36 |
| 4,5 Dimethylindan | 0.24 | 0.22 | 0.23 |
| Tridecanes | 9.58 | 10.45 | 7.72 |
| Tetradecanes | 1.64 | 1.76 | 1.22 |
| Pentadecanes | 0.12 | 0.13 | 0.08 |
| Unidentified | 0.52 | 0.63 | 0.55 |
| Total | 100.00 | 100.00 | 100.00 |
| Total Paraffins | 0.41 | 0.49 | 0.37 |
| Total Isoparaffins | 0.09 | 0.11 | 0.09 |
| Total Naphthenes | 0.66 | 0.72 | 0.66 |
| Total Aromatics | 86.98 | 85.71 | 89.31 |
| Unclassified | 11.86 | 12.97 | 9.57 |
| Total C8 | 0.01 | 0.01 | 0.01 |
| Total C9 | 3.74 | 3.68 | 4.40 |
| Total C10 | 56.36 | 55.26 | 59.37 |
| Total C11 | 27.34 | 27.38 | 26.06 |
| Total C12 | 0.69 | 0.70 | 0.59 |
| C10 Paraffin | 0.03 | 0.04 | 0.03 |
| C11 Paraffin | 0.38 | 0.45 | 0.34 |
| C11 Isoparaffin | 0.09 | 0.11 | 0.09 |
| C10 Naphthene | 0.66 | 0.72 | 0.66 |
| C8 Aromatic | 0.01 | 0.01 | 0.01 |
| C9 Aromatic | 3.74 | 3.68 | 4.40 |
| C10 Aromatic | 55.67 | 54.50 | 58.68 |
| C11 Aromatic | 26.87 | 26.82 | 25.63 |
| C12 Aromatic | 0.69 | 0.70 | 0.59 |

The C6-C10+ aromatic distribution and distillation profile for yet another typical Aromatic-150 blendstock is given in Table 4.

TABLE 4

| TEST | METHOD | UNITS | RESULTS |
|---|---|---|---|
| Distillation-IBP | ASTM D86 | ° F. | 372 |
| 5% | | ° F. | 378 |
| 10% | | ° F. | 379 |
| 20% | | ° F. | 380 |
| 30% | | ° F. | 380 |
| 40% | | ° F. | 381 |
| 50% | | ° F. | 382 |
| 60% | | ° F. | 383 |
| 70% | | ° F. | 384 |
| 80% | | ° F. | 385 |
| 90% | | ° F. | 388 |
| 95% | | ° F. | 390 |

TABLE 4-continued

| TEST | METHOD | UNITS | RESULTS |
|---|---|---|---|
| Distillation-EP | | ° F. | 407 |
| Recovery | | vol % | 98.8 |
| Residue | | vol % | 1.1 |
| Loss | | vol % | 0.1 |
| Gravity | ASTM D4052 | API | 26.9 |
| Density @ 60° F. | ASTM D4052 | kg/m$^3$ | 892.5 |
| Reid Vapor Pressure | ASTM D5191 | psi | n/a |
| Sulfur | ASTM D5453 | wt % | <1 |
| Aromatics. Total | ASTM D6733 | vol % | 98.8 |
| C9 Aromatics | ASTM D6733 | vol % | 0.7 |
| C10 Aromatics | ASTM D6733 | vol % | 60.5 |
| C11 Aromatics | ASTM D6733 | vol % | 37.6 |
| Peroxide Content | ASTM D3703 | ppm | <1 |
| Flash Point | ASTM D93A | ° F. | 10.8 |

A distillation profile for a tetralin blendstock is shown in Table 5. The relatively narrow distillation range suggests that the tetralin blendstock is comprised mostly of tetralin with only relatively minor amounts of isomers and components having slightly lower or slightly higher molecular weights being present.

TABLE 5

| TEST | METHOD | UNITS | RESULTS |
|---|---|---|---|
| Distillation-IBP | ASTM D86 | ° C. | 199 |
| 5% | | ° C. | 202.6 |
| 10% | | ° C. | 202.7 |
| 20% | | ° C. | 202.8 |
| 30% | | ° C. | 202.9 |
| 40% | | ° C. | 203 |
| 50% | | ° C. | 203.1 |
| 60% | | ° C. | 203.1 |
| 70% | | ° C. | 203.2 |
| 80% | | ° C. | 203.4 |
| 90% | | ° C. | 203.7 |
| 95% | | ° C. | 204.4 |
| Distillation-EP | | ° C. | 219.3 |
| Recovery | | vol % | 99 |
| Residue | | vol % | 1 |
| Loss | | vol % | 0 |
| Gravity @ 15.56° C. | ASTM D4052 | ° API | 13.95 |

A distillation profile for a diethylbenzene blendstock is shown in Table 6. The relatively narrow distillation range suggests the diethylbenzene blendstock is comprised mostly of diethylbenzene, with only relatively minor amounts of isomers and components having slightly lower or slightly higher molecular weights being present.

TABLE 6

| TEST | METHOD | UNITS | RESULTS |
|---|---|---|---|
| Distillation-IBP | ASTM D86 | ° F. | 353.0 |
| 5% | | ° F. | 353.2 |
| 10% | | ° F. | 353.3 |
| 20% | | ° F. | 353.5 |
| 30% | | ° F. | 353.7 |
| 40% | | ° F. | 353.9 |
| 50% | | ° F. | 354.1 |
| 60% | | ° F. | 354.3 |
| 70% | | ° F. | 354.5 |
| 80% | | ° F. | 354.7 |
| 90% | | ° F. | 355.0 |
| 95% | | ° F. | 355.6 |
| Distillation-EP | | ° F. | 371.6 |
| Recovery | | vol % | 99.2 |
| Residue | | vol % | 0.8 |

TABLE 6-continued

| TEST | METHOD | UNITS | RESULTS |
|---|---|---|---|
| Loss | | vol % | 0.0 |
| API Gravity | ASTM D4052 | ° API | 31.6 |
| Specific Gravity | ASTM D4052 | — | 0.8676 |

It is a relatively simple matter to determine the C6-C10+ distributions of aromatic species in the various aromatic refinery blendstocks, and determine appropriate amounts thereof that can be blended to obtain a final aromatic pre-blend having the desired C6-C10+ distribution.

The distribution of aromatic components (C6, C7, C8, C9 and C10+) for an aromatic pre-blend prepared in accordance with this disclosure, as determined analytically, is compared with the target aromatic component distribution from 40 CFR 1065.710(b) in Table 7.

TABLE 7

| | | | Target | | |
|---|---|---|---|---|---|
| TEST | METHOD | UNITS | MIN | MAX | Results |
| Gravity @ 60° F. | ASTM D4052 | ° API | Report | | 30.1 |
| Density @ 15.56° C. | ASTM D4052 | g/mL | Report | | 0.8756 |
| Composition, aromatics | ASTM D5769 | | | | |
| C6 aromatics (benzene) | | vol % | | 0.1 | 0.05 |
| C7 aromatics (toluene) | | vol % | 23.5 | 26.0 | 24.6 |
| C8 aromatics | | vol % | 23.5 | 25.0 | 25.0 |
| C9 aromatics | | vol % | 25.0 | 27.0 | 26.3 |
| C10+ aromatics | | vol % | 23.0 | 26.0 | 24.8 |

A compositional analysis for another aromatic pre-blend prepared in accordance with this disclosure is given in Table 8.

TABLE 8

| | WT % | LV % | MOL % |
|---|---|---|---|
| Benzene | 0.01 | 0.01 | 0.01 |
| Toluene | 23.27 | 23.31 | 28.44 |
| N-Octane | 0.01 | 0.01 | 0.01 |
| Ethylcyclohexane | 0.01 | 0.01 | 0.01 |
| Ethylbenzene | 3.14 | 3.15 | 3.33 |
| Meta-Xylene | 10.85 | 10.91 | 11.51 |
| Para-Xylene | 4.08 | 4.12 | 4.33 |
| 2-Methyloctane | 0.01 | 0.01 | 0.01 |
| 3-Methyloctane | 0.01 | 0.01 | 0.01 |
| Ortho-Xylene | 5.15 | 5.09 | 5.46 |
| N-Nonane | 0.01 | 0.01 | 0.01 |
| Isopropylbenzene | 0.05 | 0.05 | 0.05 |
| n-Propylbenzene | 0.14 | 0.14 | 0.13 |
| 1-Methyl-3-ethylbenzene | 0.22 | 0.22 | 0.21 |
| 1-Methyl-4-ethylbenzene | 0.23 | 0.23 | 0.22 |
| 1,3,5-Trimethylbenzene | 0.05 | 0.05 | 0.05 |
| 1-Methyl-2-ethylbenzene | 0.10 | 0.10 | 0.09 |
| 1,2,4-Trimethylbenzene | 26.49 | 26.29 | 24.82 |
| Isobutylbenzene | 0.04 | 0.04 | 0.03 |
| sec-Butylbenzene | 0.06 | 0.06 | 0.05 |
| N-Decane | 0.01 | 0.01 | 0.01 |
| 1,2,3-Trimethylbenzene | 0.05 | 0.05 | 0.05 |
| 1-Methyl-3-isopropylbenzene | 0.04 | 0.04 | 0.03 |
| Indan (2,3-Dihydroindene) | 0.01 | 0.01 | 0.01 |
| 1,3-Diethylbenzene | 9.36 | 9.41 | 7.85 |

TABLE 8-continued

| | WT % | LV % | MOL % |
|---|---|---|---|
| 1,4-Diethylbenzene | 12.59 | 12.68 | 10.56 |
| 1,2-Diethylbenzene | 0.03 | 0.03 | 0.03 |
| 1-Methylindan | 0.06 | 0.06 | 0.05 |
| 1,2-Dimethyl-3-Ethylbenzene | 0.02 | 0.02 | 0.02 |
| 1,2,4,5-Tetramethylbenzene | 0.02 | 0.02 | 0.02 |
| 1,2,3,5-Tetramethylbenzene | 0.01 | 0.01 | 0.01 |
| 4-Methylindan | 0.02 | 0.02 | 0.02 |
| 5-Methylindan | 0.01 | 0.01 | 0.01 |
| Pentylbenzene | 0.02 | 0.02 | 0.02 |
| Naphthalene | 0.31 | 0.27 | 0.27 |
| C11 Aromatic | 0.01 | 0.01 | 0.01 |
| N-Dodecane | 0.01 | 0.01 | 0.01 |
| 1.3,5-triethylbenzene | 0.02 | 0.02 | 0.01 |
| 5,6 Dimethylindan | 0.07 | 0.06 | 0.05 |
| 2-Methylnaphthalene | 0.82 | 0.75 | 0.65 |
| 4,5 Dimethylindan | 0.05 | 0.05 | 0.04 |
| Tridecanes | 0.24 | 0.26 | 0.15 |
| 1-Methylnaphthalene | 0.39 | 0.33 | 0.31 |
| Tetradecanes | 0.19 | 0.20 | 0.11 |
| Pentadecanes | 0.73 | 0.77 | 0.40 |
| Hexadecanes | 0.41 | 0.43 | 0.21 |
| N-Hexadecane | 0.03 | 0.03 | 0.01 |
| Heptadecanes | 0.25 | 0.26 | 0.12 |
| N-Heptadecane | 0.01 | 0.01 | 0.00 |
| Pristane | 0.01 | 0.01 | 0.00 |
| Octadecanes | 0.04 | 0.04 | 0.02 |
| Unidentified | 0.23 | 0.28 | 0.16 |
| Total | 100.00 | 100.00 | 100.00 |
| Total Paraffins | 0.04 | 0.04 | 0.04 |
| Total Isoparaffins | 0.02 | 0.02 | 0.02 |
| Total Naphthenes | 0.01 | 0.01 | 0.01 |
| Total Aromatics | 97.79 | 97.64 | 98.75 |
| Unclassified | 2.14 | 2.29 | 1.18 |
| Total C6 | 0.01 | 0.01 | 0.01 |
| Total C7 | 23.27 | 23.31 | 28.44 |
| Total C8 | 23.24 | 23.29 | 24.65 |
| Total C9 | 27.37 | 27.17 | 25.66 |
| Total C10 | 22.58 | 22.68 | 18.96 |
| Total C11 | 1.36 | 1.22 | 1.08 |
| Total C12 | 0.03 | 0.03 | 0.02 |
| C8 Paraffin | 0.01 | 0.01 | 0.01 |
| C9 Paraffin | 0.01 | 0.01 | 0.01 |
| C10 Paraffin | 0.01 | 0.01 | 0.01 |
| C12 Paraffin | 0.01 | 0.01 | 0.01 |
| C9 Isoparaffin | 0.02 | 0.02 | 0.02 |
| C8 Naphthene | 0.01 | 0.01 | 0.01 |
| C6 Aromatic | 0.01 | 0.01 | 0.01 |
| C7 Aromatic | 23.27 | 23.31 | 28.44 |
| C8 Aromatic | 23.22 | 23.27 | 24.63 |
| C9 Aromatic | 27.34 | 27.14 | 25.63 |
| C10 Aromatic | 22.57 | 22.67 | 18.95 |
| C11 Aromatic | 1.36 | 1.22 | 1.08 |
| C12 Aromatic | 0.02 | 0.02 | 0.01 |

Mol WT of Sample, gm/mol 112.59

Density of Sample, gm/cc 0.874

Total aromatics, aromatic distribution (C6, C7, C8, C9 and C10+ aromatics) and distillation profile for two additional aromatic pre-blends (DG2421BE10 and TILX353058) prepared in accordance with this disclosure are shown in Table 9.

TABLE 9

| PRODUCT: | Aromatic Pre-blend | | DG2421BE10 | TILX 353058 |
|---|---|---|---|---|
| TEST | METHOD | UNITS | RESULTS | RESULTS |
| Distillation-IBP | ASTM D86 | ° F. | 254.0 | 254.4 |
| 5% | | ° F. | 268.9 | 267.9 |
| 10% | | ° F. | 271.4 | 271.6 |
| 20% | | ° F. | 277.7 | 277.9 |
| 30% | | ° F. | 285.0 | 286.0 |
| 40% | | ° F. | 294.5 | 295.4 |
| 50% | | ° F. | 305.6 | 305.9 |
| 60% | | ° F. | 317.4 | 317.4 |
| 70% | | ° F. | 328.6 | 328.4 |
| 80% | | ° F. | 338.5 | 338.6 |
| 90% | | ° F. | 351.3 | 350.5 |
| 95% | | ° F. | 368.7 | 368.4 |

TABLE 9-continued

| | | | | |
|---|---|---|---|---|
| Distillation-EP | | ° F. | 437.8 | 427.6 |
| Recovery | | vol % | 97.8 | 97.8 |
| Residue | | vol % | 1.0 | 1.0 |
| Loss | | vol % | 1.2 | 1.2 |
| Gravity | ASTM D4052 | ° API | 30.10 | 30.20 |
| Specific Gravity | ASTM D4052 | — | 0.8756 | 0.8751 |

TABLE 9-continued

| | | | | |
|---|---|---|---|---|
| C6 aromatics (benzene) | ASTM D5769 | vol % | 0.05 | 0.05 |
| C7 aromatics (toluene) | ASTM D5769 | vol % | 24.6 | 26.0 |
| C8 aromatics | ASTM D5769 | vol % | 25.0 | 24.4 |
| C9 aromatics | ASTM D5769 | vol % | 26.25 | 26.45 |
| C10+aromatics | ASTM D5769 | vol % | 24.80 | 21.40 |

The aromatic pre-blend can then be combined with one or more paraffinic refinery blendstocks comprised primarily of paraffinic (saturated) species and having a low aromatic content (e.g., less than 5 volume percent) to obtain a mixture meeting most of the compositional, distillation profile, and fuel quality characteristics specified in 40 CFR 1065.710(b).

The specifications for an E10 test fuel in accordance with 40 CFR 1065.710(b) is given in Table 10.

TABLE 10

| | | SPECIFICATION | | | |
|---|---|---|---|---|---|
| Property | Unit | General Testing | Low-Temperature Testing | High Altitude Testing | Reference Procedure |
| Antiknock Index (R + M)/2 | — | 87.0-88.4 | | 87.0 Minimum | ASTM D2699 and D2700 |
| Sensitivity (R-M) | — | 7.5 Minimum | | | ASTM D2699 and D2700 |
| Dry Vapor Pressure Equivalent (DVPE)[d] | kPa (psi) | 60.0-63.4 (8.7-9.2) | 77.2-81.4 (11.2-11.8) | 52.4-55.2 (7.6-8.0) | ASTM D5191 |
| Distillation[e] 10% evaporated | ° C. (° F.) | 49-60 (120-140) | 43-54 (110-130) | 49-60 (120-140) | ASTM D86 |
| 50% evaporated | ° C. (° F.) | 88-99 (190-210) | | | |
| 90% evaporated | ° C. (° F.) | 157-168 (315-335) | | | |
| Evaporated final boiling point | ° C. (° F.) | 193-216 (380-420) | | | |
| Residue | milliliter | 2.0 Maximum | | | |
| Total Aromatic Hydrocarbons | volume % | 21.0-25.0 | | | ASTM D5769 |
| C6 Aromatics (benzene) | volume % | 0.5-0.7 | | | |
| C7 Aromatics (toluene) | volume % | 5.2-6.4 | | | |
| C8 Aromatics | volume % | 5.2-6.4 | | | |
| C9 Aromatics | volume % | 5.2-6.4 | | | |
| C10+ Aromatics | volume % | 4.4-5.6 | | | |
| Olefins[5] | mass % | 4.0-10.0 | | | ASTM D6550 |
| Ethanol blended | volume % | 9.6-10.0 | | | See §1065.710(b)(3) |
| Ethanol confirmatory[f] | volume % | 9.4-10.2 | | | ASTM D4815 or D5599 |
| Total Content of Oxygenates Other than Ethanol[f] | volume % | 0.1 Maximum | | | ASTM D4815 or D5599 |
| Sulfur | mg/kg | 8.0-11.0 | | | ASTM D2622, D5453 or D7039 |
| Lead | g/liter | 0.0026 Maximum | | | ASTM D3237 |
| Phosphorus | g/liter | 0.0013 Maximum | | | ASTM D3231 |
| Copper Corrosion | — | No. 1 Maximum | | | ASTM D130 |
| Solvent-Washed Gum Content | mg/100 milliliter | 3.0 Maximum | | | ASTM D381 |
| Oxidation Stability | minute | 1000 Minimum | | | ASTM D525 |

To the extent that vapor pressure, olefin content, or sulfur requirements are not within the specification, butane may be added to adjust vapor pressure, olefins (such as butene) may be added to adjust olefin content, and sulfur compounds may be added to adjust sulfur content, such that the resulting composition is fully compliant with 40 CFR 1065.710(b).

Table 11 lists the test results for an E10 test fuel prepared in accordance with the methods disclosed herein.

TABLE 11

| PRODUCT: | EPA Tier 3 EEE Emission Certification Fuel, General Testing-Regular | | | | Batch No.: Tank No.: | DE1821LT10 107 |
|---|---|---|---|---|---|---|
| | | | SPECIFICATIONS | | | |
| TEST | METHOD | UNITS | MIN | TARGET | MAX | RESULTS |
| Distillation-IBP | ASTM D86 | ° F. | | | | 97.7 |
| 5% | | ° F. | | | | 123.9 |
| 10% | | ° F. | 120 | | 140 | 131.3 |
| 20% | | ° F. | | | | 139.9 |
| 30% | | ° F. | | | | 146.7 |
| 40% | | ° F. | | | | 152.9 |
| 50% | | ° F. | 190 | | 210 | 193.3 |
| 60% | | ° F. | | | | 225.0 |
| 70% | | ° F. | | | | 248.8 |
| 80% | | ° F. | | | | 274.8 |
| 90% | | ° F. | 315 | | 335 | 315.9 |
| 95% | | ° F. | | | | 336.9 |
| Distillation-EP | | ° F. | 380 | | 420 | 380.3 |
| Recovery | | ml | | Report | | 98.0 |
| Residue | | ml | | | 2.0 | 1.1 |
| Loss | | ml | | Report | | 1.0 |
| Gravity @ 60° F. | ASTM D4052 | °API | | Report | | 58.52 |
| Density @ 15.56° C. | ASTM D4052 | — | | Report | | 0.7440 |
| Reid Vapor Pressure EPA Equation | ASTM D5191 | psi | 8.7 | | 9.2 | 9.1 |
| Carbon | ASTM D5291 | wt fraction | | Report | | 0.8262 |
| Hydrogen | ASTM D5291 | wt fraction | | Report | | 0.1368 |
| Hydrogen/Carbon ratio | ASTM D5291 | mole/mole | | Report | | 1.973 |
| Oxygen | ASTM D4815 | wt % | | Report | | 3.70 |
| Ethanol content | ASTM D5599-00 | vol % | 9.6 | | 10.0 | 9.9 |
| Total oxygentates other than ethanol | ASTM D4815 | vol % | | | 0.1 | None Detected |
| Sulfur | ASTM D5453 | mg/kg | 8.0 | | 11.0 | 10.1 |
| Phosphorus | ASTM D3231 | g/l | | | 0.0013 | None Detected |
| Lead | ASTM D3237 | g/l | | | 0.0026 | None Detected |
| Composition, aromatics | ASTM D5769 | vol % | 21.0 | | 25.0 | 23.3 |
| C6 aromatics (benzene) | ASTM D5769 | vol % | 0.5 | | 0.7 | 0.6 |
| C7 aromatics (toluene) | ASTM D5769 | vol % | 5.2 | | 6.4 | 5.9 |
| C8 aromatics | ASTM D5769 | vol % | 5.2 | | 6.4 | 6.1 |
| C9 aromatics | ASTM D5769 | vol % | 5.2 | | 6.4 | 5.6 |
| C10+ aromatics | ASTM D5769 | vol % | 4.4 | | 5.6 | 5.1 |
| Composition, olefins | ASTM D6550 | wt % | 4.0 | | 10.0 | 5.8 |
| Oxidation Stability | ASTM D525 | minutes | 1000 | | | 1000+ |
| Copper Corrosion | ASTM D130 | | | | 1 | 1a |
| Existent gum, washed | ASTM D381 | mg/100 mls | | | 3.0 | 1.0 |
| Existent gum, unwashed | ASTM D381 | mg/100 mls | | Report | | 1.5 |
| Research Octane Number | ASTM D2699 | | | Report | | 92.1 |
| Motor Octane Number | ASTM D2700 | | | Report | | 83.7 |
| R + M/2 | D2699/2700 | | 87.0 | | 88.4 | 87.9 |
| Sensitivity | D2699/2700 | | 7.5 | | | 8.4 |
| Net Heat of Combustion | ASTM D240 | BTU/lb | | Report | | 17954 |

The described embodiments are not limiting. Various modifications are considered within the purview and scope of the appended claims.

What is claimed is:

1. A process for preparing E10 test fuel in accordance with 40 CFR 1065.710(b), comprising:

(a) blending aromatic refinery blendstocks, with at least one paraffinic refinery blendstock in proportions effective to achieve a mixture having a C7:C6 aromatics ratio in units of volume of from 5.2-6.4:0.5-0.7, a C8:C6 aromatics ratio in units of volume of from 5.2-6.4:0.5-0.7, a C9:C6 aromatics ratio in units of volume of from 5.2-6.4:0.5-0.7, and a C10+:C6 aromatics ratio in units of volume of from 4.4-5.6:0.5-0.7;

(b) optionally adding butane as needed to adjust the dry vapor pressure equivalent of the E10 test fuel between 52.4 kPa and 81.4 kPa;

(c) optionally adding olefin-containing blendstocks as needed to adjust total olefins content in the E10 test fuel to a value between 4.0 and 10.0 percent on a mass basis;

(d) optionally adding sulfur-containing blendstocks or sulfur compounds as needed to provide a sulfur content of from 8.0 mg/kg to 11.0 mg/kg in the E10 test fuel; and (e) adding ethanol in an amount effective to achieve an ethanol content of from 9.4 to 10.2 percent by volume in the E10 test fuel.

2. The process of claim 1, wherein the paraffinic refinery blendstock or combination of paraffinic refinery blendstocks have a total aromatics content that does not exceed 10 volume percent.

3. The process of claim 1, wherein the paraffinic refinery blendstock or combination of paraffinic refinery blendstocks have a total aromatics content that does not exceed 5 volume percent.

4. The process of claim 1, wherein the paraffinic refinery blendstock or combination of paraffinic refinery blendstocks have a total aromatics content that does not exceed 2 volume percent.

5. The process of claim 1, wherein the aromatic refinery blendstock is at least one of Aromatic-100, Aromatic-150, Aromatic-200, benzene, toluene, xylene, 1,2,4-trimethyl benzene, 1,3,5-trimethyl benzene, diethylbenzene, and tetralin.

6. A process for preparing E10 test fuel in accordance with 40 CFR 1065.710(b), comprising:

blending aromatic refinery blendstocks with at least one paraffinic refinery blendstock in proportions such that when the blend is combined with butane as needed to adjust the dry vapor pressure equivalent of the E10 test fuel between 52.4 kPa and 81.4 kPa, olefin-containing blendstocks as needed to adjust total olefins content in the E10 test fuel to a volume between 4.0 and 10.0 percent on a mass basis, sulfur-containing blendstocks on sulfur compounds as needed to provide a sulfur content of from 8.0 mg/kg to 11.0 mg/kg in the E10 test fuel, and ethanol in an amount effective to achieve an ethanol content of from 9.4 to 10.2 percent by volume in the E10 test fuel, the resulting E10 test fuel has a C7:C6 aromatics ratio in units of volume of from 5.2-6.4:0.5-0.7, a C8:C6 aromatics ratio in units of volume of from 5.2-6.4:0.5-0.7, a C9:C6 aromatics ratio in units of volume of from 5.2-6.4:0.5-0.7, and a C10+:C6 aromatics ratio in units of volume of from 4.4-5.6:0.5-0.7.

7. The process of claim 6, wherein the paraffinic refinery blendstock or combination of paraffinic refinery blendstocks have a total aromatics content that does not exceed 10 volume percent.

8. The process of claim 6, wherein the paraffinic refinery blendstock or combination of paraffinic refinery blendstocks have a total aromatics content that does not exceed 5 volume percent.

9. The process of claim 6, wherein the paraffinic refinery blendstock or combination of paraffinic refinery blendstocks have a total aromatics content that does not exceed 2 volume percent.

10. The process of claim 6, wherein the aromatic refinery blendstock is at least one of Aromatic-100, Aromatic-150, Aromatic-200, benzene, toluene, xylene, 1,2,4-trimethyl benzene, 1,3,5-trimethyl benzene, diethylbenzene, and tetralin.

* * * * *